United States Patent [19]

Bailey et al.

[11] Patent Number: 4,943,465

[45] Date of Patent: Jul. 24, 1990

[54] THERMAL INSULATING, HIGH TEMPERATURE RESISTANT COMPOSITE

[75] Inventors: Douglas J. Bailey, Snyder; Paul Boymel, Kenmore; Juan M. Cerdan, Tonawanda, all of N.Y.

[73] Assignee: The Carborundum Company, Cleveland, Ohio

[21] Appl. No.: 261,944

[22] Filed: Oct. 24, 1988

[51] Int. Cl.[5] ..... B32B 3/06; B32B 31/20

[52] U.S. Cl. ..... 428/102; 428/255; 428/280; 428/920; 156/93

[58] Field of Search ..... 428/102, 234, 255, 280, 428/282, 920; 156/93

[56] References Cited

U.S. PATENT DOCUMENTS

| | | | |
|---|---|---|---|
| 2,808,338 | 10/1957 | Bruno et al. | 106/69 |
| 2,811,457 | 10/1957 | Speil et al. | 106/69 |
| 3,055,831 | 9/1962 | Barnett et al. | 252/62 |
| 4,221,672 | 9/1980 | McWilliams | 252/62 |

OTHER PUBLICATIONS

Form C 737-J; 2/88, pp. 1-2, Standard Oil Engineered Materials, "Fiberfrax ® Ceramic Fiber Papers General Information".

E. A. Skrabek, "Thermal Performance of High Temperature Insulation Materials In Aerospace Environments", Refract., Fr., 1979, vol. 16, pp. 361-370.

*Primary Examiner*—Alexander S. Thomas

*Attorney, Agent, or Firm*—George W. Moxon, II; Joseph G. Curatolo; Larry W. Evans

[57] ABSTRACT

Provided is a composite for use as thermal insulation in high temperature environments. The composite comprises a layer of randomly laid and oriented, fine diameter, heat resistant fibers interlocked together into the form of a shape sustaining paper having a high fiber index and two lateral surfaces, said paper being compressed to produce a paper which has a thickness of from about 0.01 to 0.50 inch and a density of about 6 to about 30 lb/cu.ft. A high temperature resistant scrim is disposed upon each of the lateral surfaces of the paper, and a network of abrasion-resistant, high temperature-resistant threads is stitched through the scrim and the paper such that the scrim is mechanically locked to the paper by said threads. The network of threads and the scrim substantially retain the structural integrity of the said paper to maintain said paper in compression.

22 Claims, No Drawings

THERMAL INSULATING, HIGH TEMPERATURE RESISTANT COMPOSITE

The present invention relates to a thermal insulating, high temperature resistant composite, which composite has improved thermal insulating characteristics in abrasive, high temperature and moisture environments.

BACKGROUND OF THE INVENTION

Thermal insulating materials which are used, for example, in the aerospace industries must meet some difficult requirements. The materials are often used at very high temperatures. The demands for low weight materials or weight reduction means that to increase insulation one cannot simply increase the number of layers or the thickness of the insulation. The insulation is used frequently to cover intricate shapes and so must be flexible enough to be shaped. Further, the materials are frequently subjected to severe environmental conditions, including high temperatures and moisture conditions.

One approach has been to make high temperature resistant fibers into flexible shapes such as "papers". These can provide dimensional requirements which allow for the shaping of the insulation while being light in weight. These sheet materials are known in the art as "papers" because they are often made by paper-making methods, although the thickness thereof can be up to one-half inch or more. These papers can be made by laying staple fibers into a mat and consolidating the mat into a paper, although other processes may be used. The staple fibers used in making these papers are heat resistant inorganic fibers such as glass, metal or ceramic fibers. By virtue of the laying operation, the staple fibers are randomly oriented and, with consolidation, are interlocked together into the form of a shape sustaining paper having two lateral surfaces. The papers are used as protective lining against high temperature, but they have other uses, such as a high temperature filtering medium.

Papers which have been used as insulation materials often have incorporated in them "filler" materials, such as aerogels of silica, chromic oxide, thoria, magnesium hydrate, alumina or mixtures thereof. The fillers, usually in the form of particles, serve to increase the density of the paper, lower its thermal conductivity and improve its insulation value. The filler particles are held by the reinforcing skeleton or network of staple reinforcing fibers, i.e., the paper, often aided by the use of organic or inorganic binders or by utilizing some inherent adhesive quality of the particles. This produces sheets of insulation material which have some flexibility and can be shaped and molded. Examples of these are given in U.S. Pat. Nos. 2,808,338, 2,811,457, 3,055,831 and 4,221,672.

To avoid the loss of structural integrity of the fiber skeleton during mechanical action, e.g. abrasion, flexing, and the like, the papers often have a binder applied thereto. These binders take various forms, but generally speaking the binders are organic polymers such as phenolics, acrylic and epoxies. The binders serve to improve the structural integrity of the papers during manufacture and fabrication of the papers into products.

However, the binders of these papers, while quite satisfactory at ambient temperatures, will begin to lose the binding effect at elevated temperatures, with a consequential loss of structural integrity of the papers. At even higher temperatures, and the temperatures at which these protective papers are normally used, the binder will burn away and the structural integrity of the paper and/or the filler particles will depend entirely upon the interlocking of the fibers. This is not as problem for papers which have been mechanically manipulated, conformed and fitted to the configuration of the particular apparatus in which it is used, it is most often held in place by the apparatus itself and substantial independent structural integrity of the paper itself is not required.

One solution to improve the mechanical life of such papers is that proposed in U.S. Pat. No. 4,499,134 to E. F. Whitely et al, the teachings of which are incorporated herein by reference. Whitely's solution was to mechanically bond a scrim to the outside of the paper by a network of threads. This "quilted" composite was then better able to retain the structural integrity of the paper in abrasive, high temperature environments.

But, the mechanical bonding is not adequate if the filler particles incorporated into the paper to increase its density and thermal resistance become unbonded or loose due to vibration or other mechanical or thermal action. Further, the filler particles may be adequate at high temperatures, but their performance or characteristics may be affected or changed under atmospheric conditions which cause the paper to become wetted and dried.

It would be, therefore, of considerable advantage to the art to provide improved papers, of the nature described above, wherein the structural integrity or insulating value of the papers can be largely maintained at higher temperatures if the binder burns away from the papers or where the papers are subject to wetting or to abrasion.

It is, therefore, an object of the present invention to provide such materials having improved structural integrity, improved insulation values and suitable for use in an abrasive, high temperature environment. It is a further object of the invention to provide such materials where the structural integrity and insulation value is largely maintained even when the material is used at temperatures sufficiently high that a binder material is burned away. It is a further object of the invention to provide such materials which can be made relatively inexpensively, are easily manipulated, shaped, formed for use both for original construction purposes and for repair purposes. It is a further object of the invention to provide methods for producing such materials. Other objects will be apparent from the following description of the invention and from the annexed claims.

BRIEF DESCRIPTION OF THE INVENTION

The invention is based on the discovery that heat resistant fiber and using small diameter fibers paper having a high fibers index can be compressed and used in combination with a mechanical means to maintain structural integrity to provide an improved high temperature composite material having good wet/dry and insulating properties.

The mechanical means suitable for retaining the structural integrity of the papers are very suitably in the form a scrim disposed on both lateral surface of the paper thus forming a composite. The scrim need not contribute any substantial thermal protecting and/or insulating properties, and can be a lightweight scrim, so long as the scrim has the degree of structural integrity needed to maintain the paper in a compressed state. Scrims of high structural integrity are known to the art and can be produced by relatively inexpensive methods such as the fusing of randomly oriented molten extruded fibers and filaments or by the weaving of yarns. Thus the scrim can be either a woven or non-woven scrim.

Further, a suitable mechanical attachment of the scrim to the paper in forming the composite is by way of stitching the scrim to the paper to firmly attach the scrim to the paper. The stitching may be random or in a patterned form, such that the retained structural integrity is essentially uniform over the length and width of the composite, although a repeating quilting pattern of stitching is particularly advantageous.

As can be appreciated the invention involves a composite of the paper and the scrim stitched together. Thus the scrim, stitched to the paper, will allow the composite to substantially retain the paper in a state of compression. Since there are no binders needed and no particulate fillers, the composite will perform better under conditions of vibration or wetting and drying.

Thus, briefly stated, the present invention provides a composite having good insulation value and suitable for use in high temperature, vibration and/or wet/dry environments, comprising small diameter randomly laid and oriented heat resistant fibers interlocked together into the form of a shape sustaining paper with a high fiber index and having two lateral surfaces, and thickness of from about 0.01 to 1.0 inch. A high temperature resistant scrim is disposed upon each of the lateral surfaces of the paper, and a network of abrasion-resistant, high temperature-resistant threads is stitched through the scrim and the paper such that the scrim is mechanically locked to the paper by the threads and the network of threads and the scrim substantially retain the structural integrity of the composite to hold the paper in compression.

DETAILED DESCRIPTION OF THE INVENTION

It should be initially appreciated that the composite of the present invention utilizes a paper which in combination with a mechanical means for providing structural integrity provides a composite which is flexible and shapeable, but with improved wet/dry and insulative properties.

The papers may be a needled felt, a dry or liquid laid non-woven fabric, or the like, including the more traditional papers made by a process similar to the paper making process. Hence, the details of these papers, and the processes for making those papers, will not be recited herein for sake of conciseness, but instead an overall description of a preferred embodiment of papers and processes therefor will be presented for continuity of understanding the present invention.

Thus, briefly stated, the papers of the preferred embodiment of present invention, are randomly laid and oriented heat resistant fibers. The laying, which can be by either a conventional dry-lay or a conventional wet-lay process, causes the fibers to randomly orient and interlock together during the laying process into a mat. The mat is then consolidated into a paper by any one or more or a number of known processes, such as a roto-former or a Fourdrinier machine or the like. These papers will, generally, have a thickness of about 0.01 to 0.50 inch, and up to 1.0 inch, but especially 0.01 to 0.3 inch and will generally have an overall bulk density of between 5 and 15 lbs/ft$^3$.

Although not necessary to this invention, a binder may be used, such as a soluble binder dissolved in a liquid of a wet process and retained in the paper after consolidation, or in the form of soluble or fusable fibers used in a wet or dry process and disposed in the paper as produced. All of the foregoing is well known in the art and no further details are necessary, but if used, the binder should be capable of sufficiently binding the fibers together such that the paper has a structural integrity sufficient to withstand substantial continued ambient flexing of the paper without substantial loss of the structural integrity of the paper. If a binder is used, it may be burned away either before or during the use of the composite, or purposely burned away either prior to or after fabricating the composite into an article. But, it is preferred not to use a binder since it eliminates the additional manufacturing steps and avoids combustion byproducts.

The ceramic fiber is preferably selected from the group consisting of fibers of alumina-silica, alumina-silica-zirconia, polycrystalline mullite fibers, calcium-alumino-silicate, alumina, mineral fibers and the like. The particular fiber is chosen dependent upon the temperature and atmospheric conditions anticipated in service in a manner well known to those skilled in the art of high temperature thermal insulation using ceramic fibers.

Of the above-given classes of fibers, those of alumina-silica and alumina-silica-zirconia, such as those sold by The Carborundum Company of Niagara Falls, N.Y., under the trademark Fiberfrax® ceramic fibers are preferred for installations where the continuous use temperature will not exceed 1427° C. (2600° F.). When higher service temperatures are contemplated, Fiberfrax® alumino-silicate ceramic fibers may be admixed with Fibermax™ polycrystalline mullite fibers which are available from The Carborundum Company of Niagara Falls, N.Y. When polycrystalline mullite fibers alone are employed, continuous service temperatures may be as high as 1649° C. (3000° F.).

The manufacture of alumino-silicate refractory fibers is described in U.S. Pat. No. 2,557,834. The manufacture of alumina-silica-zirconia refractory fibers is described in U.S. Pat. No. 2,873,197. The manufacture of polycrystalline oxide fibers of, for example, aluminosilicate, is described in U.S. Pat. Nos. 4,159,205 and 4,277,269. A particularly preferred ceramic fiber for use in the present invention is an alumino-silicate ceramic fiber having a continuous service temperature upper limit of about 1260° C. (2300° F.), and a mean fiber diameter of up to 2 microns.

The method of manufacture of the ceramic fibers is not critical. Fibers produced by blowing, spinning, sol-gel and other methods may be used. A preferred fiber is made by attenuating and breaking up a molten stream or sol-gel system having a typical $SiO_2$-$Al_2O_3$ binary chemistry.

Because it is necessary to use a paper having a high fiber index, the ceramic fibers may need to be refined to remove the shot which naturally occurs during formation of such ceramic fibers by blowing or spinning of a molten stream of ceramic material with a high velocity stream of air or rapidly rotating wheels respectively. It is preferred to produce a paper having a fiber index of more than about 85%, with a fiber index of at least 90% and more than 95% also being preferred and a fiber index of about 100% being further preferred.

The term "fiber index" is intended to mean the weight of fiber to non-fiber in the paper. Non-fiber would include shot or non-fiberous materials. "Fiber index" is measured by a wet process in which a quantity of the paper is placed in a container filled with water. Using a commercially available high shear mixer, the fiber mass is agitated so that the fibers and any particles such as shot or fillers become dispersed. The dispersed mixture is then overflowed into a second container in which the water swirls in a cyclonic pattern so that the fibers become separated from the shot or other particles. The fibers are then captured on a screen and the dried weights of each of the fibers and the particles are measured. The weight percentage of fibers in the total of fibers and particles can then be calculated.

Length of the ceramic fibers is not critical. Fibers of a length which cannot be readily handled may be chopped into reduced lengths to facilitate laying-up in the paper making process.

Diameter of the ceramic fibers is critical. Typically, commercially available ceramic fibers sold for use as thermal insulation range in diameter from about 0 to about 12 microns, with an average or mean diameter of about 2–4 microns. The fibers employed in the present invention range in diameter from about 0 to 8 microns with a average diameter of about 0.1 to about 1.75 microns, with the range 0.5 to 1.5 microns being a preferred average diameter.

Once the paper is fabricated, it is compressed using a conventional roller or plate press or the like, i.e., by a continuous or batch process, to produce a compressed, paper. It can either be manufactured to the desired size or can be layed-up or stacked, either in a batch or continuous process, each of which is well known, in the art, to produce a composite paper which will have the desired thickness. For example, three sheets of about one-eighth inch thick paper could be stacked and compressed to form a composite paper having a thickness of about one-eighth inch.

The amount of compression and manner in which it takes place are not critical, but the preferred amount of compression will be about 20% to 500% of the initial thickness of the paper as formed. As noted in the example above, when three ⅛ inch thick papers are layed-up and compressed to form a ⅛ inch thick paper, the compression is 300%. The exact amount of compression will depend upon the starting papers as well as the insulation and flexibility demands, but the objective is to approach an insulation value that is equal to or less than the molecular conductivity of still air.

Next, a high temperature scrim is disposed upon each of the lateral surfaces of the paper. There is no criticality in the scrim, either in its materials, structure, or the like, other than it should possess enough structural integrity to maintain the paper in its compressed state. The scrim could be woven or non-woven, although fiberglass or quartz are preferred. The scrims can be light, i.e., have a weight of from 0.5 to 4.0 oz./yd$^2$ although weights of about 1 to 10 oz./yd$^2$ are acceptable. Further, it is the combination of the scrim with the mechanical means which maintains the compression. Thus, there can be some latitude in the selection of the scrim and the mechanical means as long as it serves its function. Examples of suitable scrims are Fiberglass Fabric, E-Glass, Style 1581 and Quartz Fabric No. 503 both are available from J.P. Stevens Company.

The fibers of all of the scrim, paper and threads are inorganic fibers, e.g. glass fibers, such as E or S glass fibers, ceramic fibers such as silica or aluminumsilica fibers, metal fiber such as copper, brass, bronze, aluminum, steel or aluminum fibers. However, it is preferred that the scrim and threads be made of glass or quartz fibers and the paper be made of ceramic fibers, especially alumina-silica fibers.

The scrim or scrims are attached to the paper by way of a network of high temperature-resistant threads (staple or continuous fibers) stitched through the scrim and the paper such that the scrim is mechanically locked to the paper by the threads. The network of threads are stitched through the scrim and paper in either a patterned configuration or a random configuration. Thus, the threads may be simply laid onto the scrim and needled through the scrim and paper by needle-punching and this will produce a random configuration of the threads passing through the scrim and paper. Since the scrim is placed on both sides of the paper, the needle-punching must either be from both sides of the paper or after needle-punching a scrim on one side, the paper is reversed and another scrim is needle-punched on the other side. Regardless of the method, the stitching and quilting process details are well known in the art.

However, it is greatly preferred that the threads are stitched through the scrim and paper in a patterned configuration and that the patterned configuration is a stitching achieved by sewing. The scrims are mechanically locked to the paper by threads in the form of stitching lines of threads which pass through the scrim as well as the paper. The preferred embodiment is a pattern of stitching, achieved by sewing, in the form of a repeating quilting pattern, although the stitching could be in parallel lines. The patterns of the quilting repeat at least every four inches, and more preferably at least every two inches, although a one inch pattern is preferred. However, the patterns may repeat at much greater or smaller spaced intervals. The term "quilting" as used in the specification and claims is intended to have the ordinary meaning of spaced apart lines of stitching which define and enclose unstitched portions.

It can therefore be seen that the networks of threads forming the stitching and the scrims will allow substantial retention of the structural integrity of the composite during use. This in turn provides a composite which has structural integrity, in abrasive, high temperature use, far greater than that which would be provided by the paper alone and the thermal protection of the composite remains intack.

The particular geometric shape of the repeating pattern is not critical and may be the diamond shape, or it may be circular, oval, rectangular, triangular or square. Indeed, the pattern could be combinations of any of the foregoing or irregular shaped patterns such as are often found in bedding quilts, although there is no advantage thereto. In any event, the pattern and the spacing thereof should be sufficient to insure that the scrim is mechanically secured to the paper.

The scrim or scrims may be sewed to the paper by conventional sewing operations using conventional sewing machines, either of an automatic and multiple head nature or of a manually operated single head nature. Since sewing operations of this nature are well known to the art, they need not be described herein for sake of conciseness.

The preferred method of producing the present composite is similar to that of the prior art in connection with the production of the paper. Thus, the preferred method includes laying heat resistant fibers into a laid matt, consolidating the laid matt (by conventional methods as described above) into a paper of about 0.01 to 0.50 inch. Next, the matt or scrim is compressed and a high temperature resistant scrim is applied to the lateral surfaces of the paper and the scrim is stitched to the paper with a network of high temperature resistant threads by either the needling process or the sewing process as described above, in either a random or patterned stitching are similar to the prior art. Thus, the general steps of the process, except for the compression, parallels the conventional process for producing papers of this nature and need not be described in detail herein.

However, the composite of the present invention departs from the prior art in the nature of the paper being one made from fine diameter, high surface area fibers having a high fiber index, as well as being a compressed paper. This results in a composite with a good insulation value and better vibration resistance and wet/dry characteristics and which may thus be used for the construction of a variety of ultimate products. Thus, it may be manipulated, cut, configured, sewn, etc. such that it is in many configurations.

The invention will now be illustrated in connection with the following example. However, it will be appreciated that the invention is not limited to the specific example, but extends to the breadth of the foregoing disclosure and annexed claims.

EXAMPLE

The paper used in this example is a high-temperature paper having a fiber index of about 100% and composed mainly of alumina-silica fibers, having a mean fiber diameter of about 0.5 microns and is commercially available as HSA paper from The Carborundum Company. The paper as received is approximately 0.125 inch thick and has a density of about 7.0 to about 8.0 lbs/ft$^3$.

To make a ⅜ inch composite, six layers of the high fiber index paper were layed-up and compressed about 200% such that they produced a composite paper having a thickness of about 0.375 inch and a density of about 15 lbs/ft$^3$. Next, a quartz woven fabric scrim, commercially available from the J.P. Stevens Company as No. 503 Quartz Fabric, weighing 7 oz/yard$^2$, being about 0.005 inch thick, and composed mainly of quartz yarns was sewn to the paper with quartz threads such as are commercially available as Type Q-24 sewing threads from A. A. I. Products, Inc., using a sewing machine in a quilting pattern which repeated every one inch. The quilting pattern was a regularly shaped square. The threads were stitched with approximately one thread loop every 1/16 inch. The ⅛ inch composite was used as a thermal insulation material and could be manipulated and shaped without imposing its insulation value.

The thus formed composite was compared to a product made from Fiberfrax® 550 paper, which is also available from The Carborundum Company and is considered typical for ceramic fibers, and Min-K HT composite insulating material, which is a particulate and fiber composite made by a dry lay-up process and which is believed to be similar to or based upon that described in U.S. Pat. Nos. 2,808,338; 2,811,457; and 3,055,831. The Min-K HT composite has a scrim quilted to each side and has a density of 18.8 lbs/cu.ft.. The particulate is microporous silica and opacifiers.

The Fiberfrax® 550 paper has a fiber index of about 50% is made from alumina-silica staple fibers having a mean diameter of about 2.2 microns, and has a density of about 12 lbs/cu.ft. A Fiberfrax® 550 paper composite was made using two layers of a ¼ inch thick Fiberfrax® 550 paper, which were placed in compression by compressing the paper about 33% to result in a composite density (including the scrim) of 20 lb/cu.ft.

A hot face/cold face comparison test was run between ⅜ inch composites made in accordance with the present invention and the Fiberfrax® 550 paper composite where each paper composite has been made as discussed above. Each composite was made using the same scrims and threads and quilted in the same manner and pattern.

The hot face/cold face test is a common test used in the insulation industry to demonstrate the thermal conductivity of composite materials. In the test, one lateral surface of a composite is placed against a surface of a known and constant temperature—this being the hot face—and then the temperature of the opposite, lateral, face of the composite, which is the cold face, is measured over a regular period of time. The temperature of the cold face will rise until it reaches a steady state temperature. In a comparative test, this will show relative insulation values.

When the composite paper of the invention was placed against a 1800° F. hot face, in the hot face/cold face test, the cold face of the composite paper of the present invention achieved a steady state temperature of 275° F. as compared to a 350° F. temperature for the composite paper made from Fiberfrax® 550 paper. This also shows that the composite of the invention has value as an insulation material as well as its being an improved insulation material.

Next, a ⅜ inch composite in accordance with the present invention and a ⅜ inch Min-K HT a microporous silica and fiber composite were compared in a wet/dry test. In this test, each was immersed in water until they would no longer take on water and then each was oven dried until there was no change in weight. This indicated that they were dry. Each composite paper was measured in terms of its thermal conductivity and hot face/cold face performance both before they were wetted and then after they were dried. The results showed that a composite paper in accordance with the present invention is unaffected, while the thermal conductivity of the microporous silica filed paper composite increased 55% and its cold face temperature increased 57%. Thus, the composite of the present invention was stable in wet/dry performance while the microporous silica filed paper composite decreased in its insulation value.

Thus it will seem that the objects of the invention have been achieved. It will also be appreciated that the present composite may be used in high-temperature conditions where ordinary papers cannot survive under those conditions. In this regard, the term "high-temperature" is defined to mean that temperature at which a binder of the paper would burn away. Normally, organic binders used in such papers will burn away at about 300° to 400° F., and nearly all of the binders will burn away at temperatures in excess of 500° F. Similarly, the term "suitable for use in an abrasive environment" is intended to mean those environments where ordinary papers, by virtue of mechanical action thereon, would begin to quickly loose their structural integrity once the binder of the papers (if used) burned away. These terms and conditions will be easily understood and appreciated by those skilled in this art.

It will also be appreciated that various modification of the foregoing disclosure will be apparent to those skilled in this art. For example, if desired, an opacifier, such as titanium dioxide, chromium dioxide, iron oxide, magnesium dioxide, or the like, as are known in the art, could be incorporated into the paper. Thus, the invention is intended to extend to the spirit and scope of the annexed claims.

We claim:

1. A thermal insulation composite having improved structural integrity and suitable for use in high temperature environments, comprising:

(1) randomly laid and oriented heat resistant fibers having an average diameter of about 0.1 to 1.75 micron interlocked together into the form of a shape sustaining paper having two lateral surfaces, said paper having a thickness of from about 0.1 to 1.0 inch, a fiber index of more than 85%, and a density of about 5 pounds per cubic foot to about 15 pounds per cubic foot, said paper being compressed from about 20% to about 500% from its original thickness to make a paper having a density of about 6 to 30 pounds per cubic foot.

(2) a high temperature resistant, flexible, woven or non-woven scrim having a weight of from 0.5 to 10 oz./yd$^2$ disposed upon each of the lateral surfaces of the said paper; and (3) a network of abrasion-resistant, high temperature-resistant threads stitched through said scrim and said paper in the form of stitching lines of a repeating pattern such that said scrim is mechanically locked to said paper by said threads;

whereby, the said network of threads and said scrim substantially retain the structural integrity of the said paper to maintain said paper in compression.

2. The composite of claim 1 wherein said paper has a fiber index of more than about 90%.

3. The composite of claim 1 wherein said paper has a fiber index of more than about 95%.

4. The composite of claim 1 wherein said paper has a fiber index of about 100%.

5. The composite of claim 1 wherein the fibers of the paper, scrim and threads are made of inorganic fiber.

6. The composite of claim 5 wherein the fibers of the scrim and threads are glass fibers and the fibers of the paper are ceramic fibers.

7. The composite of claim 5 wherein the threads and the fibers of the scrim are quartz fibers.

8. The composite of claim 5 wherein the threads and the fibers of the scrim are graphite fibers.

9. The composite of claim 5 wherein the threads and the fibers of the scrim are aramid fibers.

10. The composite of claim 1 wherein the thickness of the paper is from 0.10 inch to 0.30 inch.

11. The composite of claim 1 wherein the configuration is patterned and the stitching is by sewing.

12. The composite of claim 11 wherein the pattern is a repeating quilting pattern.

13. The composite of claim 12 wherein the pattern of the quilting repeats at least every four inches.

14. The composite of claim 12 wherein the pattern repeats at least every two inches.

15. The composite of claim 12 wherein the pattern repeats at least every one inch.

16. A method for producing the composite of claim 1, comprising:

(1) laying heat resistant fibers having an average diameter of about 0.1 to about 1.75 microns into a laid mat;

(2) consolidating the laid mat into a paper having a thickness of about 0.01 to 1.0 inch, having a fiber index of more than 85%, having a density of about 5 to about 15 lb/cu.ft., and having two lateral surfaces;

(3) compressing said mat from about 20% to about 500% to form a densified, compressed, composite paper having a density of about 6 to about 30 lb/cu.ft.;

(4) disposing a resistant, flexible, woven or nonwoven scrim having a weight of from 0.5 to 10 oz./yd$^2$ on each lateral surface of the paper; and (5) stitching the scrim to the paper with a network of abrasion-resistant, high temperature resistant threads in the form of stitching lines of a repeating pattern to thereby substantially retain the structural integrity of said paper and maintain said paper in compression.

17. The method of claim 16 wherein the fibers of the paper scrim and threads are made of inorganic fibers.

18. The method of claim 16 wherein the stitching is by sewing.

19. The method of claim 16 wherein the pattern is a repeating quilting pattern.

20. The method of claim 19 wherein the pattern of the quilting repeats at least every four inches.

21. The method of claim 19 wherein the pattern of the quilting repeats at least every one inch.

22. The method of claim 19 wherein the pattern of the quilting repeats at least every two inches.

* * * * *